US007273979B2

(12) United States Patent
Christensen

(10) Patent No.: US 7,273,979 B2
(45) Date of Patent: Sep. 25, 2007

(54) WEARABLE SENSOR MATRIX SYSTEM FOR MACHINE CONTROL

(75) Inventor: Edward Lee Christensen, 151 Calderon Ave. #75, Mountain View, CA (US) 94041

(73) Assignee: Edward Lee Christensen, Hayward, CA (US)

( * ) Notice: Subject to any disclaimer, the term of this patent is extended or adjusted under 35 U.S.C. 154(b) by 164 days.

(21) Appl. No.: 11/012,768

(22) Filed: Dec. 15, 2004

(65) Prior Publication Data

US 2006/0123982 A1 Jun. 15, 2006

(51) Int. Cl.
*G10H 1/00* (2006.01)

(52) U.S. Cl. ..... 84/615; 84/744; 84/422 R; 200/512

(58) Field of Classification Search ..... 84/423 R, 84/744, 615; 200/512
See application file for complete search history.

(56) References Cited

U.S. PATENT DOCUMENTS 4,177,705 A 12/1979 Evangelista
4,630,520 A 12/1986 Bonanno
5,099,738 A 3/1992 Hotz
5,140,887 A 8/1992 Chapman
5,248,843 A * 9/1993 Billings ..... 84/609
5,557,057 A 9/1996 Starr
5,674,018 A * 10/1997 Kaufman et al. ..... 400/473
5,741,990 A * 4/1998 Davies ..... 84/423 R
5,841,052 A 11/1998 Stanton
6,018,119 A 1/2000 Mladek
6,093,879 A * 7/2000 Pye ..... 84/451
6,392,131 B2 * 5/2002 Boyer ..... 84/424
6,444,891 B1 9/2002 Koo
6,501,011 B2 12/2002 Wesley
6,570,078 B2 5/2003 Ludwig
6,670,535 B2 12/2003 Anderson
6,689,947 B2 2/2004 Ludwig

* cited by examiner

*Primary Examiner*—Lincoln Donovan
*Assistant Examiner*—David S. Warren

(57) ABSTRACT

A real-time controller of devices such as computers, synthesizers, and processors. It consists of a portable ergonomic body housing a configurable pressure sensitive array of sensors. Ideally suited as a MIDI controller, it may be used to control musical sounds, lighting systems, media viewers, or video games in a real-time or performance environment.

7 Claims, 10 Drawing Sheets

WEARABLE SENSOR MATRIX SYSTEM FOR MACHINE CONTROL

FIELD OF INVENTION

This invention relates to complex machine and electronic musical instrument control by means of pressure originating from an operator's fingers or hands.

BACKGROUND OF THE INVENTION

Many prior popular input methods for computers and other machines have been based on outdated models such as the typewriter for text, adding machines for numbers, or the piano keyboard for music. These antiquated input methods, while familiar, leave considerable room for improvement.

Occasionally, departures from established methods in this field have lead to revolutionary results. An example of an input device or machine controller without an antecedent is the computer mouse. It is an input device that was conceived with the computer graphic user interface (GUI) in mind. Its functional excellence comes from its ability to continuously navigate and manipulate on two dimensions, matching the structure of the computer monitor. This excellent example of form following function makes the computer mouse intuitive to use and highly effective. Its third dimension of control, clicking or selecting, is Boolean however; an object is either selected or it is not. While not a major drawback for most applications, graphic artists have commented that real paint brushes and pencils have an additional level of expression due to their response to pressure variations that can not be reproduced by the mouse. To solve this problem, new interfaces have been invented such as the WACOM tablet and some touch screens, that address the third dimension by incorporating pressure into their range on control. While an improvement, these controllers do not allow for more than one input location to be manipulated at a time, making them ill suited for polyphonic music performance or true concurrent GUI object manipulation.

Musical instruments have traditionally been a combination of a mechanism that vibrates and a method of initiating and controlling that vibration. In the past, these two features were intrinsically related, e.g. the violin's fingerboard provides a means for shortening, and thus manipulating its vibrating string, which makes the sound. However, with the invention of electric, electronic, and digital oscillators, there is no longer the need for the design of the instrument to be based on the way it makes sound. Instead, an instrument in the form of an interface may be designed for the way humans think about, and physically make music.

In the art of electronic music and instruments, most devices played as an input to a music synthesizer are essentially switching devices that operate in conjunction with standardized digital control data called MIDI, or Musical Instrument Digital Interface. Although originally invented to provide a means for musical keyboards to communicate and control each other, MIDI is a powerful means of controlling all kinds of digital machines. MIDI controlled sound synthesizers, lighting systems, and media players, are popular among musicians and technicians today. In fact, machines whose only output is MIDI data are becoming increasingly common, and are known as MIDI controllers.

Keyboard organs have been in use since the tenth century. And today, the most popular input method for the production of music from the digital realm, is the piano/organ keyboard. However, the piano keyboard has some musical, ergonomic, and technical problems including: 1. limited chord-voicing and chord range possibilities, 2.limited dynamic control, 3. being a large instrument requiring the performer to sit or stand in one location, 4. not being chromatically intuitive (favors C Major, adding to difficulty in learning how to play), 5.limited percussive speed and precision, 6.limited sustain, vibrato, and portamento control.

Non-piano keyboard music control methods have been invented for electronic music. However they are often very specialized, limited in musical expression, not intuitive to learn, or physically difficult to use. For example, an early electronic musical instrument, the THEREMIN, had a new method for controlling pitch and dynamics. The elevation of the player's hand in the air near the instrument controls pitch, while a hand moving left or right controls the volume. However, it was very difficult to play, because it lacked tactile or visual references. It also had the limitation of being monophonic.

The AIRSYNTH by ALESIS, is a modern controller that, like the THEREMIN, uses the location in space of the players hands to effect musical changes. As is true with the THEREMIN, it also has difficulties in its ability to precisely control information and thus has limited musical expression.

The KEYTAR or ROLAND'S AX-7 makes the piano keyboard portable during performance. However, it sacrifices pitch range, and playability to do so.

Many patents have been issued for MIDI controllers that are based on acoustic instruments other than the piano. The guitar is a common model. These include, STAR LAB'S ZTAR and controllers taught in U.S. Pat. Nos. 5,557,057; 4,336,737; 4,570,521; 6,444,891 and 4,630,520. They all have range and expressive restraints due to their attempted emulation.

Realizing the musical instrument design possibilities afforded by sensors or switches and MIDI, a few examples of arrayed sensor based instruments exist. STARR LAB's MT-48DD is a 4×12 array of 2" rubber mounds that can be played with the feet or with mallets. More popular examples include AKAI's MPC/MPD series and a multitude of drum machines with their pressure sensitive pads. While excellent percussive input devices, none achieve full harmonic polyphony or range, or, can be played while the performer is moving across a stage.

U.S. Pat. Nos. 6,501,011 and 6,670,535 describe examples arrayed sensor MIDI controllers for music that, by attempting to build western harmonic music theory into their key layout, have made an instrument that is very difficult to understand and play in a traditional chromatic way.

Traditional controllers of audio recording equipment consist of large tabletop mixing "boards" or "desks". Because of their size, the operator has only one point of view of the program he or she is controlling. This is often a problem as sound is greatly influenced by environment and the proximity of the listener to the source. A portable control unit would be very useful to an audio technician adjusting sound to get an optimum quality throughout a space.

Like the audio engineer fixed to a location behind his or her controller, the lighting technician gets only one visual perspective of his or her lighting sets. This can lead to a number of problems both for the lighted performer and for the audience.

Video game controllers have advanced greatly from the days of the single "joystick" and "fire" button. However, many popular video game controllers require the player to hold the controller. This manual holding means that part of the hand is not being utilized for control functions. Often, as is true with SONY's PLAYSTATION controllers, only four fingers total, are available to actually play the game.

Today, with performers increasingly embracing media technology, more dynamic methods of control are needed.

SUMMARY OF THE INVENTION

The present invention is a controller of electronic machines, synthesizers, and processors comprising a wearable ergonomic body, a configurable pressure sensitive control surface of arrayed sensors, an encoder to translate sensor manipulations into digital control data, and, a cable or wireless method to connect the controller to slave machines.

The objects and advantages of this controller address all the disadvantages cited above.

It is an object of the present invention to provide precise control of slave machines by using discrete pressure aware sensors with a high degree of accuracy and repeatability.

It is another object of the present invention to provide the ability of the operator to move, stand or sit while using.

It is another object of the present invention to provide intuitive operation by using a logical key layout with graphic and tactile references.

It is another object of the present invention to provide maximum user comfort and playability by placing the control surface on the player's body is such a way as to keep hand and arm strain to a minimum.

It is further object of the present invention to provide an aesthetically pleasing design in body shape, materials, and finishes.

It is a further object of the present invention to provide utilization for multiple types of slave machines and playing preferences by allowing the input control surface to be configured both in appearance and in function.

Still further objects and advantages will become apparent from a consideration of the ensuing description and drawings.

BRIEF DESCRIPTION OF THE DRAWINGS

The invention may be more clearly understood from the following detailed description and by reference to the drawing in which.

DETAILED DESCRIPTION

Figure 1:
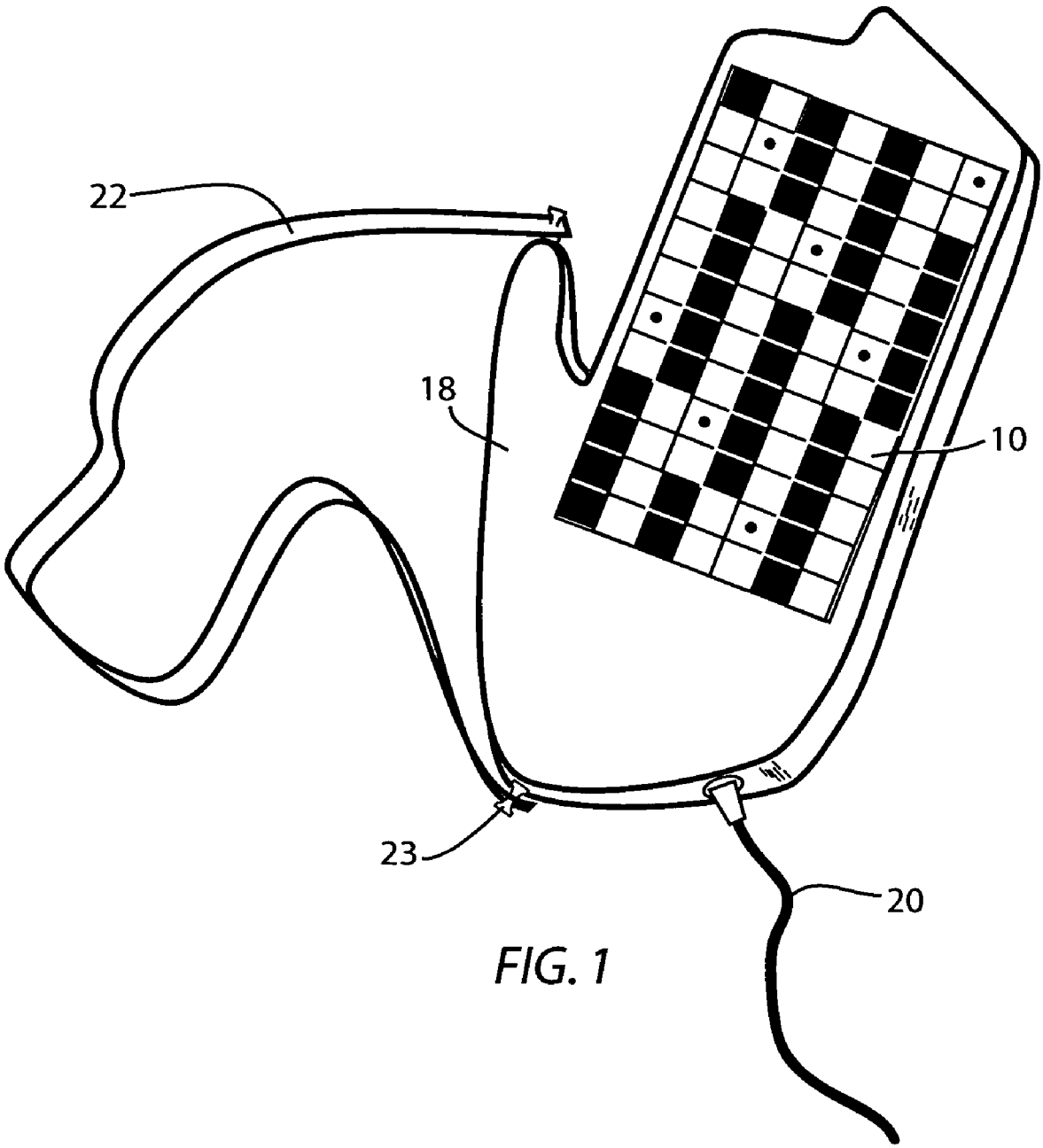
FIG. 1 is a perspective view of an embodiment of the controller.
Figure 2:
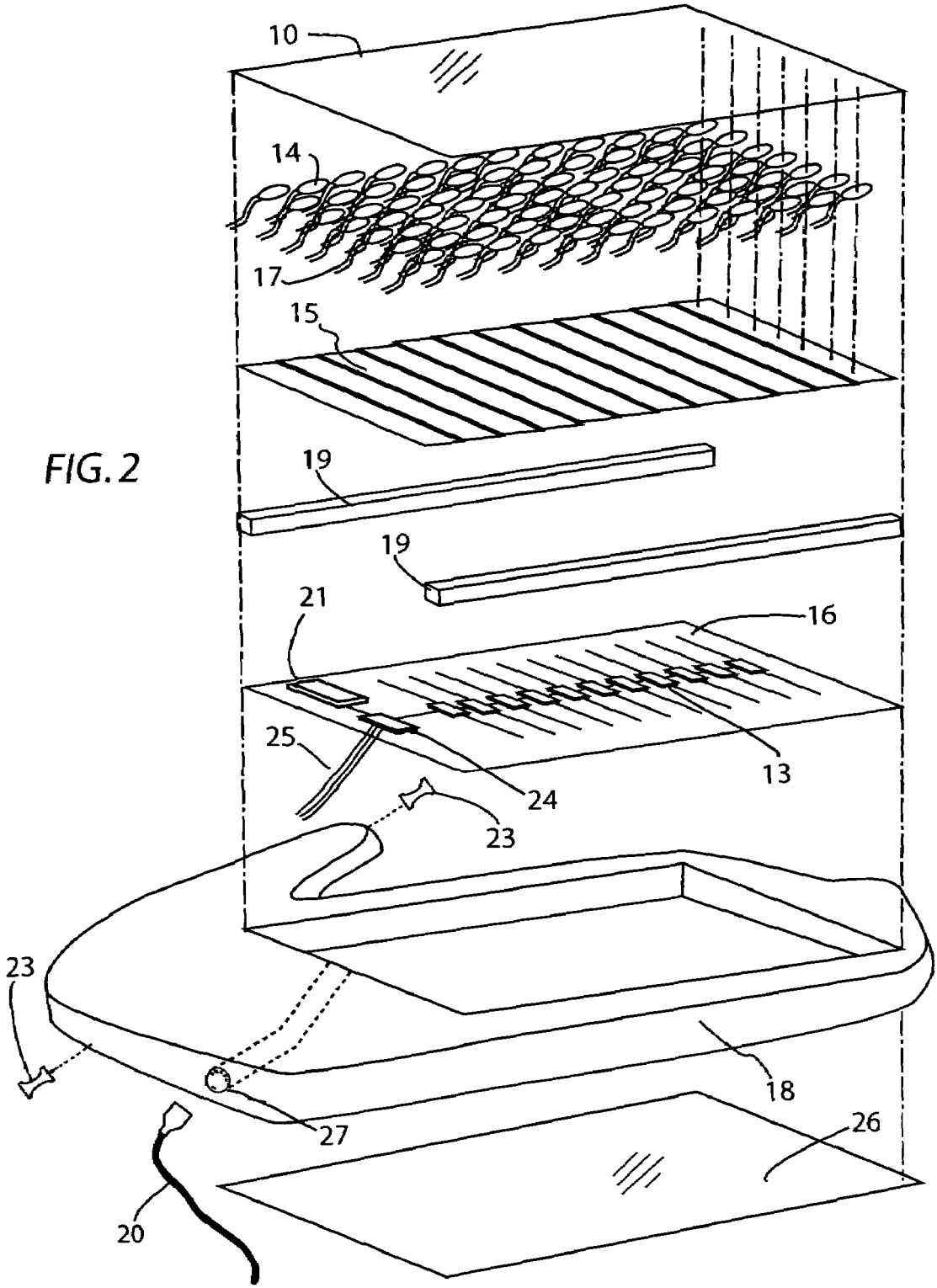
FIG. 2 is an exploded view of the controller.

The invention is described below, with reference to detailed illustrative embodiments. It will be apparent that a system according to the invention may be embodied in a wide variety of forms. Consequently, the specific structural and functional details disclosed herein are representative and do not limit the scope of the invention.

The main system components of the controller are: an electronic control system, and, a system for holding the control system comfortably on a human operator. The holding system consists of a body 18 with back cover 26, a strap 22, and hardware 23 to attach the strap 22 to the body 18. The control system of this embodiment consists of an array of pressure sensitive sensors 14 arranged seven across by twelve high. An example of a suitable sensor is the "Force Sensing Resistor Model 402" by INTERLINK ELECTRONICS. The sensors 14 are attached to a series of rigid sheets 15, which form a backing support stretcher for a single row of sensors 14. The support stretchers are attached to spacer rails 19 which are then attached to the encoder board 16. The sensors 14 connect to the MIDI encoder board 16 below by means of connecting leads 17. Covering the sensors 14 is a flexible laminate 10 with graphics printed on it. The graphics provide a visual and/or tactile reference for the operator. The laminate 10, is removable to allow for other laminates to be installed with different graphics.

Figure 5:
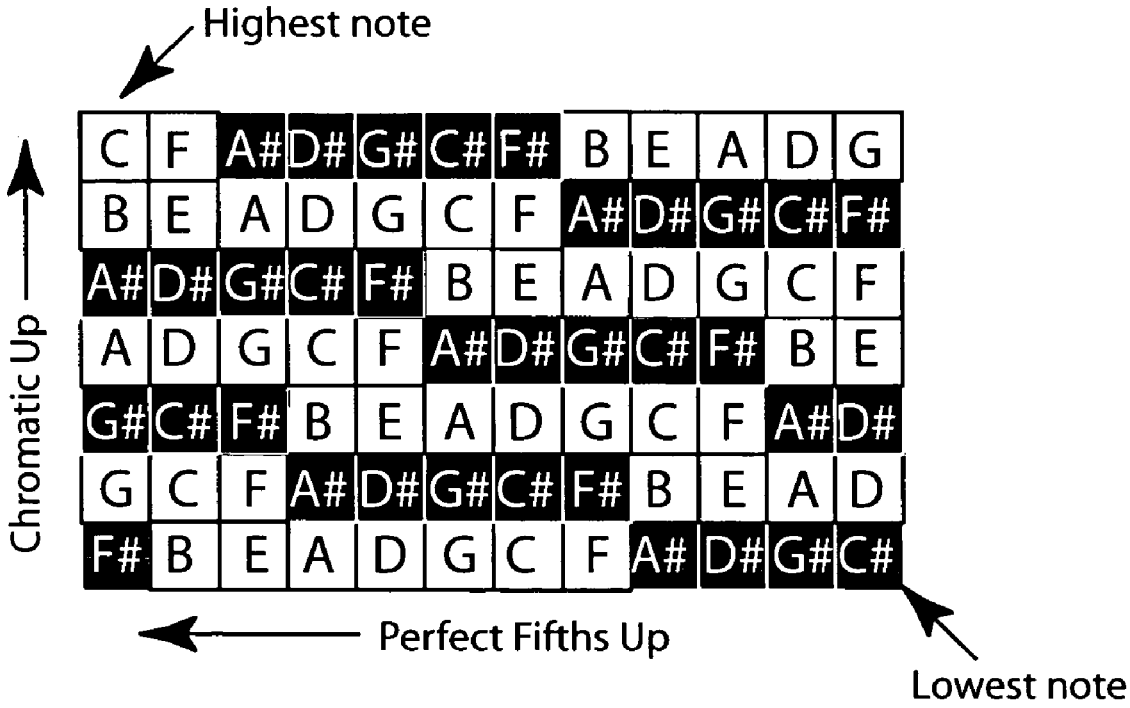
FIG. 5 is a top view of the control surface configured for musical performance with note names labeled.
Figure 6:
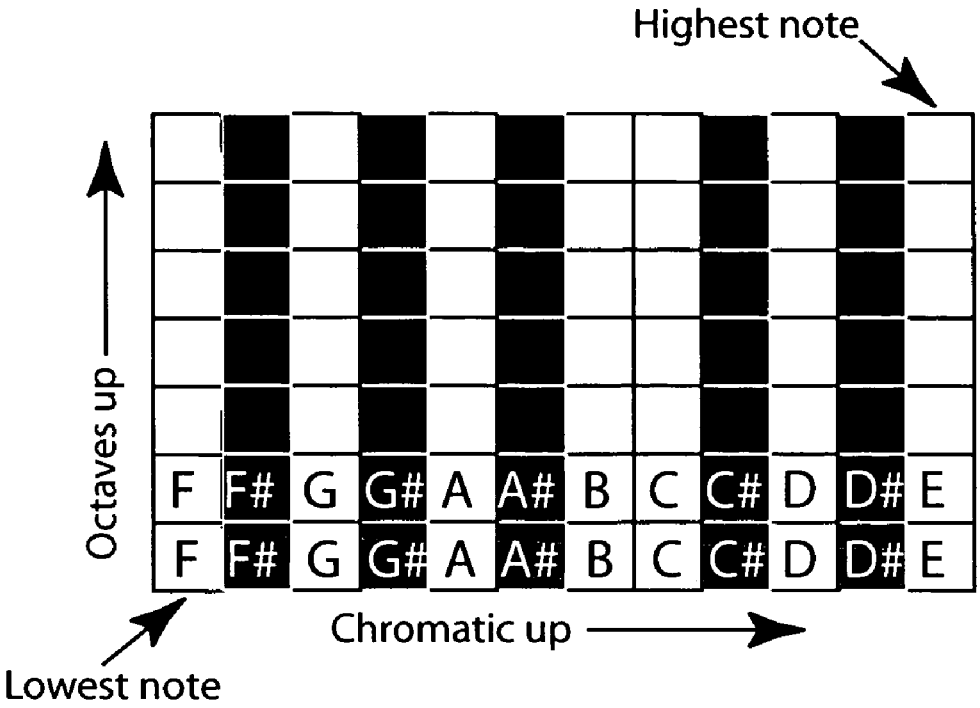
FIG. 6 is an alternative top view of the control surface configured for musical performance.
Figure 7:
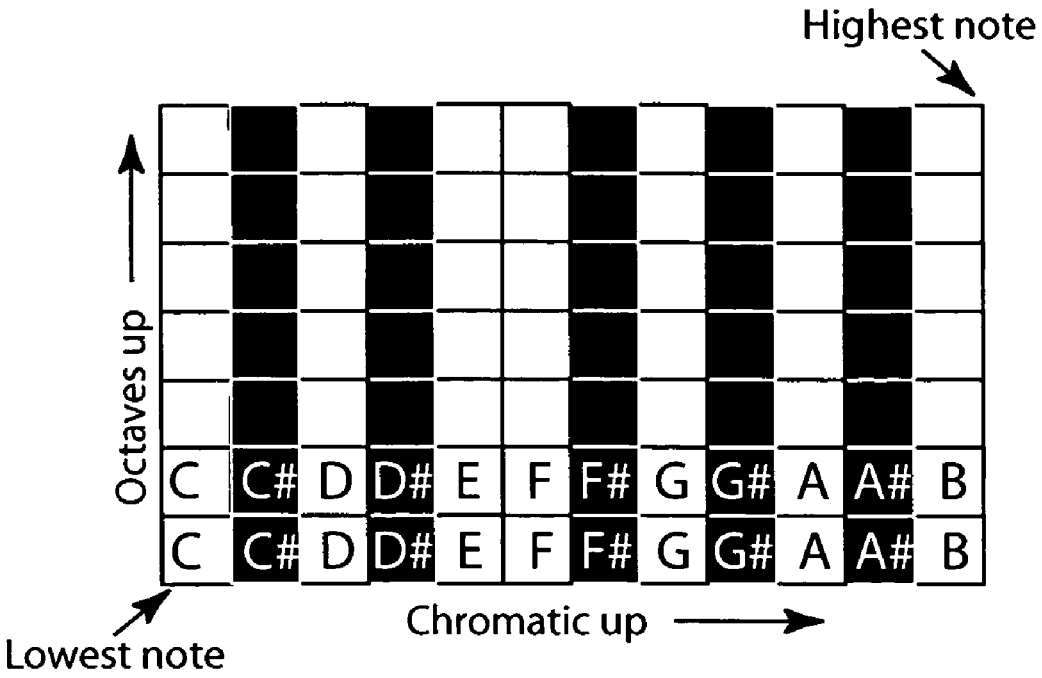
FIG. 7 is an alternative top view of the control surface configured for musical performance.
Figure 8:
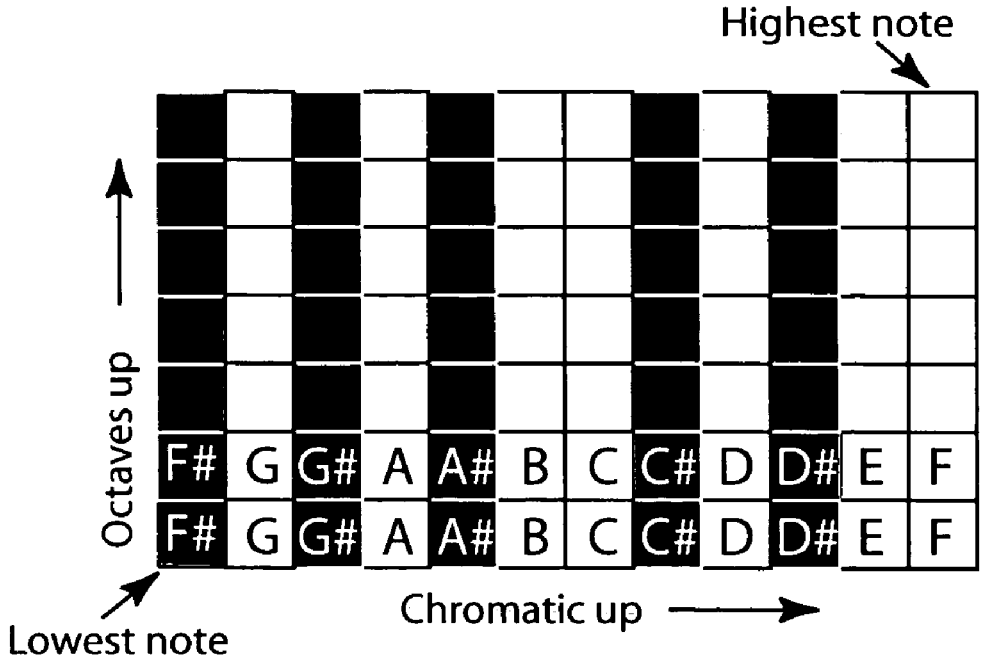
FIG. 8 is an alternative top view of the control surface configured for musical performance.
Figure 9:
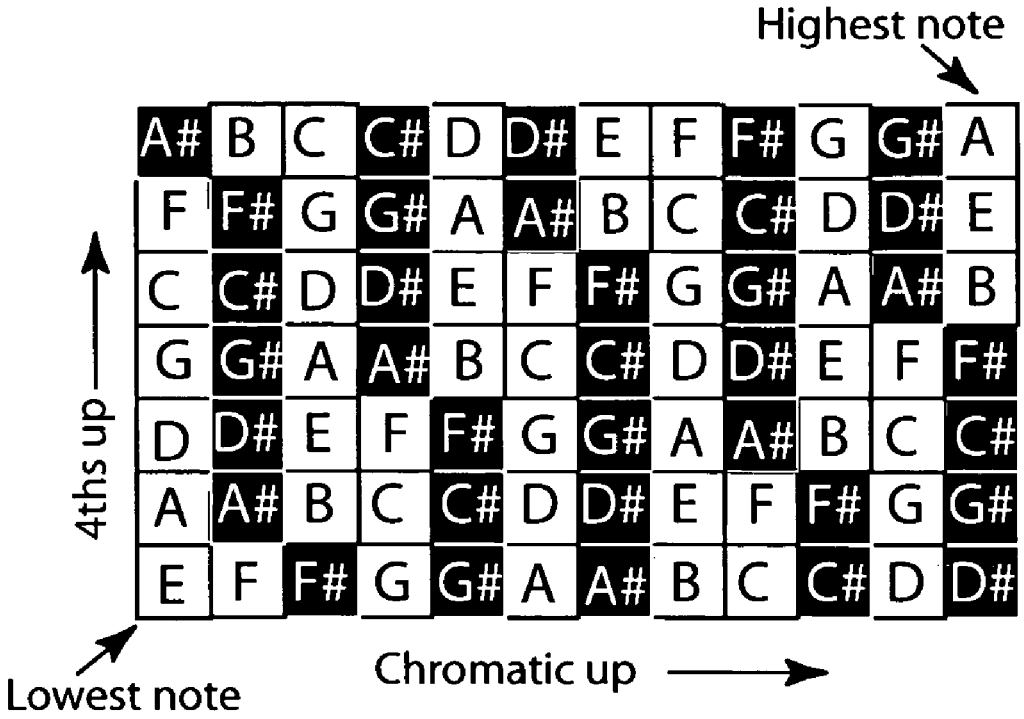
FIG. 9 is an alternative top view of the control surface configured for musical performance.

One embodiment of the control surface is illustrated in FIG. 1 & FIG. 5, with graphics on the laminate designed for musical control. In this embodiment of the printed control surface laminate, the lowest pitch is located at the bottom left of the array, and the highest pitch is at the upper right (FIG. 1 & FIG. 5). Pitches move chromatically up from left to right, and vertically adjacent sensors 14 represent an interval of a perfect fifth. Black areas represent accidentals, analogous to a piano's keyboard. This arrangement is ideal for music performance. This arrangement allows for over four octaves to be spanned by a single hand. Chords are easily formed because the notes of a perfect fifth, an interval found in most chords, are adjacent.

The remainder of the control system consists of a MIDI encoder circuit board 16 to translate the fluctuations of pressure on the sensors 14 into MIDI data. The MIDI encoder is a circuit board that consists of a programmable microprocessor or microcontroller 24 and multiplexing integrated circuits 13. The MIDI encoder 16 samples the sensors 14 to determine if a sensor 14 is experiencing pressure. The sensors 14 are pressure sensitive resistors, each connected in series to create a voltage divider. The resulting voltage is fed into one of several analog to digital converters 13 which send their information to the microcontroller 24. The microcontroller 24 tracks which sensors 14 are pressed and outputs appropriate MIDI messages to the output wires 25 which connect to a five pin DIN connector 27 which allows a MIDI cable 20 to be connected.

Figure 3:
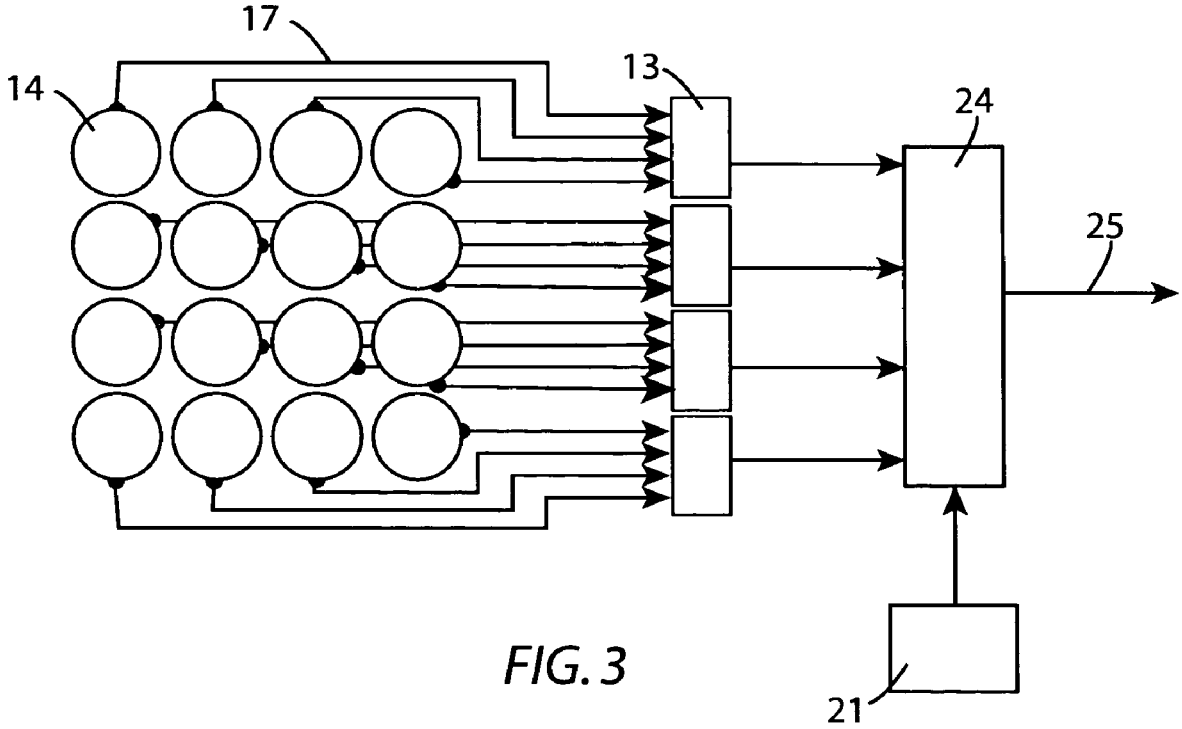
FIG. 3 is a block diagram of the electronics comprising the control system.
Figure 4:
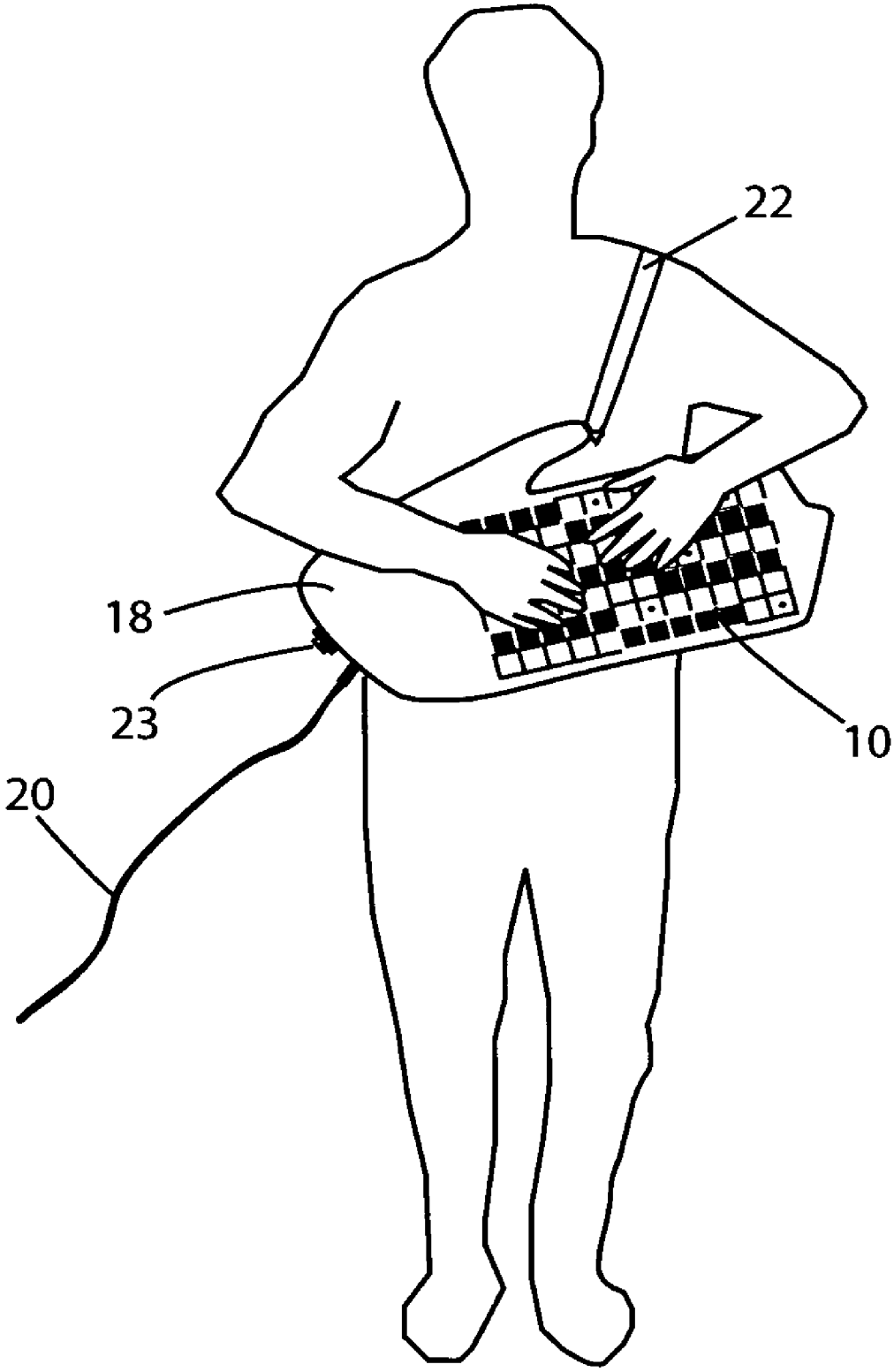
FIG. 4 displays the playing position of the controller in relationship to the human operator wearing it.

A block diagram of the controller is shown in FIG. 3. As described above, sensors 14 are coupled to the illustrated plurality of analog to digital converters 13 via multiplexing. Outputs from the analog to digital converters 13 are received by the microcontroller 24 and converted to the appropriate MIDI data. Microcontrollers with the requisite inputs and outputs, as well as the programming for such microcontrollers to accomplish the described conversion, are well known to practitioners of ordinary skill.

When in use as a musical instrument, the encoder sends four types of messages based on the state of the sensor. First, the encoder sends a "note on" message when it first determines the sensor has been pressed. Next, it samples the initial pressure amount and sends a "velocity"0 message for that sensor. Third, the encoder continues to monitor the sensor and sends "after-touch" or other "continuous controller" messages based on changes in pressure. Finally, the encoder sends a "note off" message when pressure ceases on the sensor. The encoder is capable of analyzing at least ninety-six inputs concurrently, with a cycling sampling rate of 10 milliseconds or less.

The described embodiment includes a MIDI cable 20 as its means to transfer data from the MIDI encoder to its slave machine completing the electronic function of the controller. A battery pack 21 provides power to the MIDI encoder.

The second main system of the controller consists of an apparatus to hold the control system comfortably on the player's person, in a way that provides easy access for manipulation of the control system by the user's hands. The largest aspect of the holding apparatus is the body 18. It encompasses the control system excluding the MIDI cable 20 and provides a means for attaching a strap or harness with mounting hardware 23. The described embodiment of the controller includes a shoulder strap 22 to be worn over the left shoulder and under the right arm, in a similar manner as to a guitar. The body 18 is carefully shaped to rest balanced on the operator's body. The body 18 in the described embodiment is made of finished wood, and includes a back cover 26 for access to the electronics.

The controller provides for the graphic laminate 10 over the sensor array to be changed to provide the operator with configurations based on playing styles. The embodiments of FIGS. 6-9 are examples of changes that make the controller more intuitive to piano/organ players. The column of twelve sensors represent a chromatic scale spanning an octave.

Also by installing alternative configuration programming and replacing the graphic laminate 10, the controller can have many non-musical control functions. The embodiments of FIGS. 6-15 are other possible graphic designs for use with different types of slave machines or software.

Figure 10:
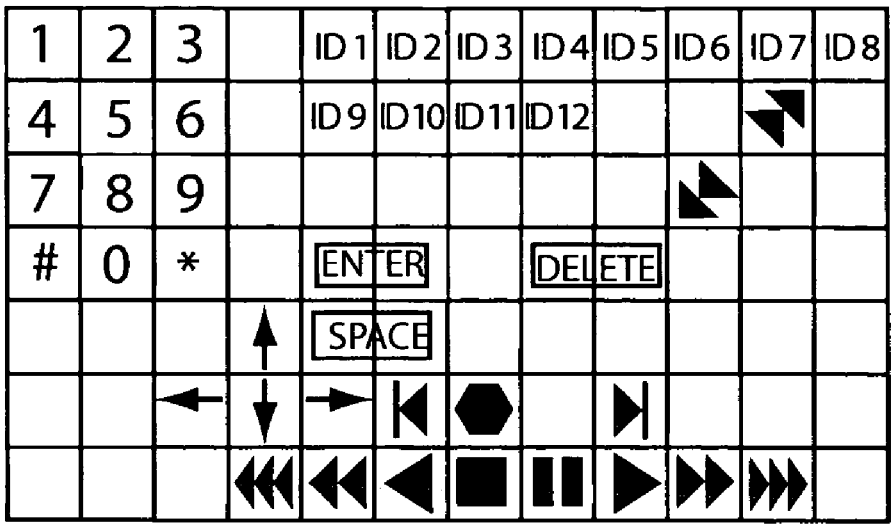
FIG. 10 is a top view of the control surface configured for electronic audio and video media control.

The controller's surface configured as in the embodiments of FIG. 10, can be used to initiate the play or display, stop or removal, pause, fast forward and rewind, of graphics, video, audio, or other media types in a linear or non-linear fashion. Traditional tape transport control can be easily implemented on the control surface. Sensors may be assigned to buttons in a variety of ways. Two pressure sensors can be used to shuttle forward or backwards with higher pressure causing faster movement. Alpha-numeric key designations and marker or ID points can be assigned to specific sensors.

Figure 11:
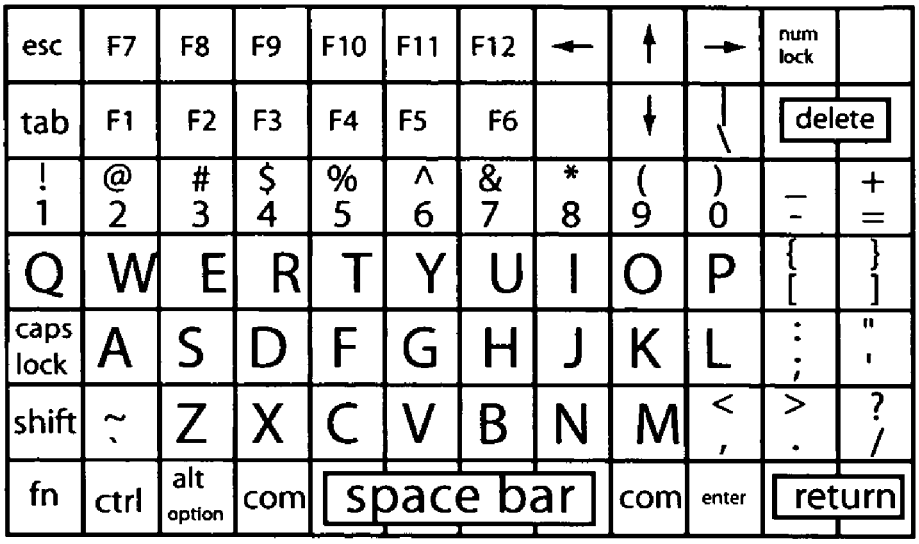
FIG. 11 is a top view of the control surface configured for entering text and computer keyboard emulation.

The controller may be used to enter text by configuring it as is shown in FIG. 11.

Figure 12:
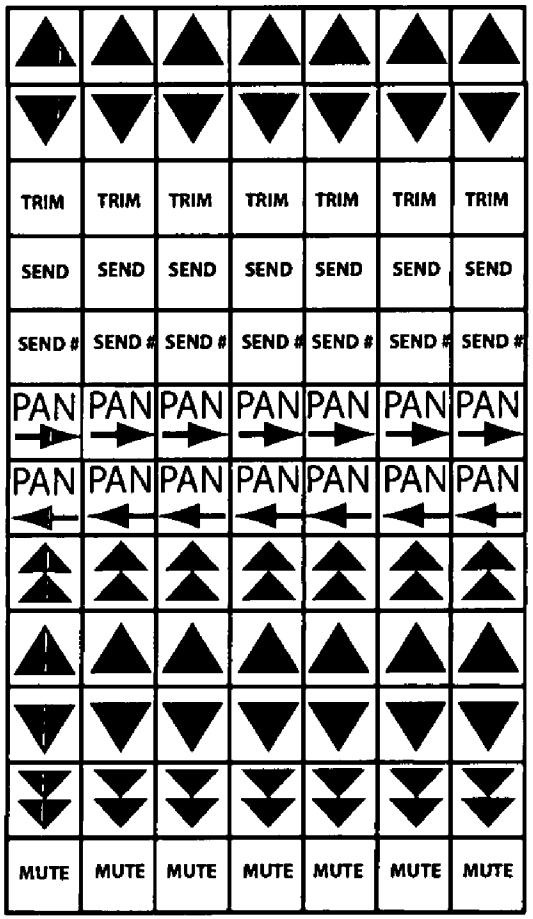
FIG. 12 is a top view of the control surface configured for audio mixing.

The controller may be configured to be a means of controlling audio in a manner similar to a mixing board by configuring the control surface as illustrated in FIG. 12. Because the control surface consists of rows and columns of sensors, lines of sensors are easily made to control over a range similar to a potentiometer. For example, a line of sensors may represent a slider on a mixing board, making the controller a master for the numerous MIDI controlled or software mixing boards.

Figure 13:
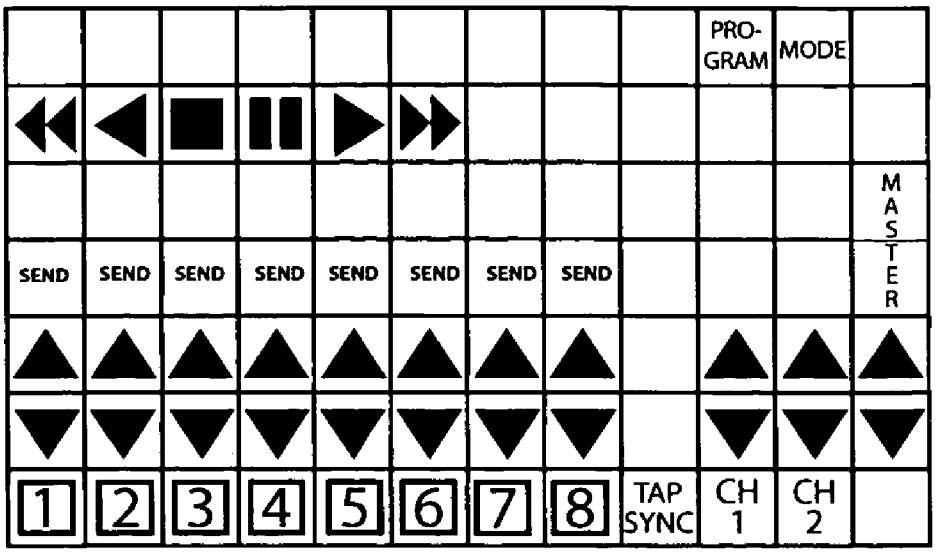
FIG. 13 is a top view of the control surface configured for video game control.
Figure 14:
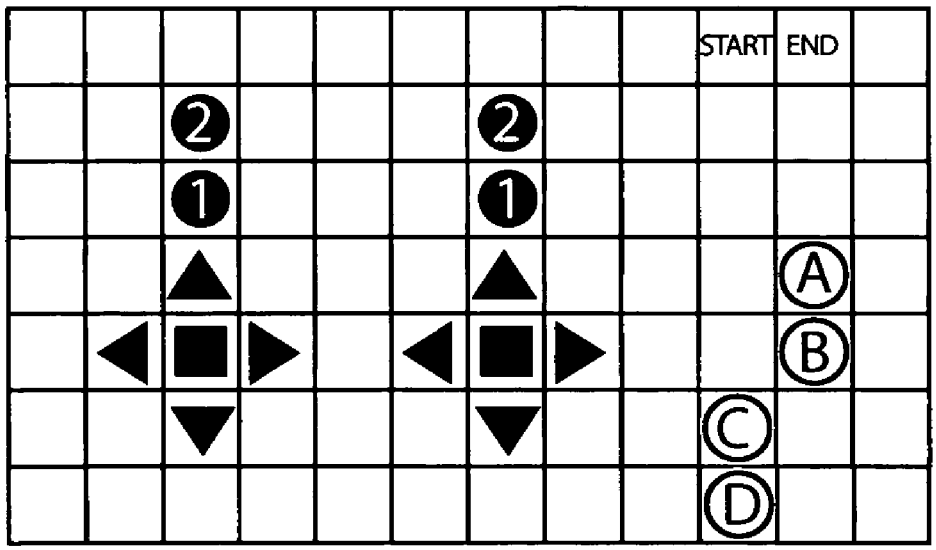
FIG. 14 is a top view of the control surface configured for DJ use.

Overlapping its musical instrument strengths, the controller can be configured to control devices that play samples, loops, and effects, making it an effective DJ control center (FIG. 13).

This controller is an effective means of controlling static images or "slides" in a non-linear manner. Configured for this purpose, each sensor could represent a single image, meaning the operator could move from one image to any other one immediately.

Video game controllers comprise of a method of directional control, various buttons, and triggers. These controls may be accomplished by the invention by installing the graphic laminate illustrated in FIG. 14.

Figure 15:
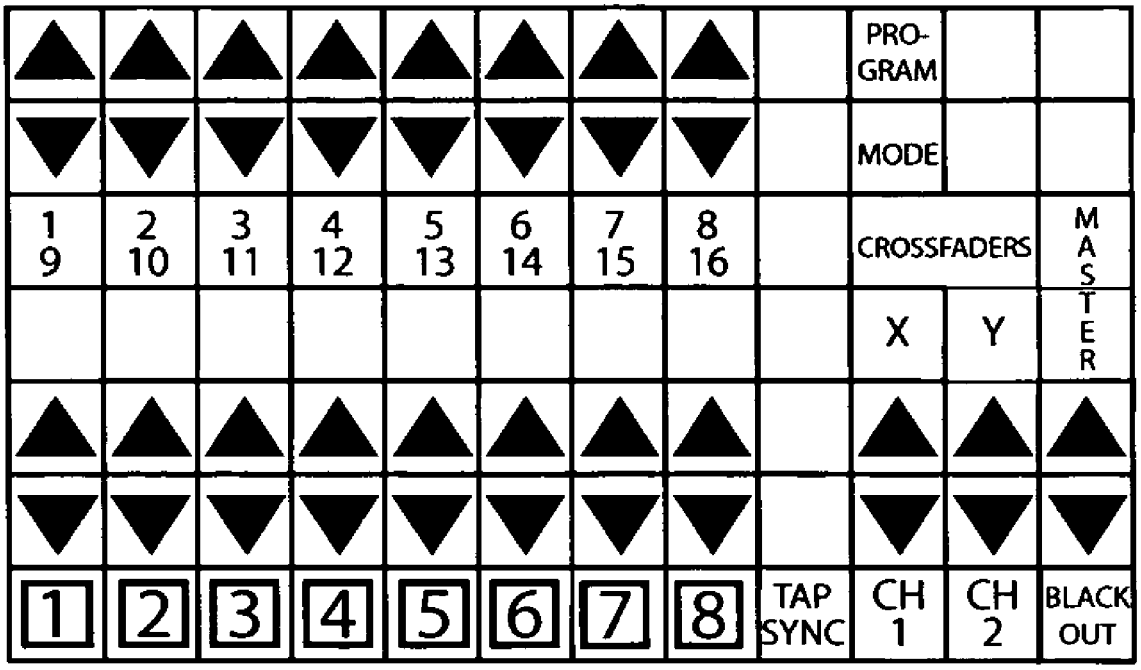
FIG. 15 is a top view of the control surface configured as a lighting controller.

Preprogrammed lighting sets or individual lights can be initiated, terminated, brought-up dimmed or cross-faded, using the controller configured with the graphic illustrated in FIG. 15.

The above configuration options are only a few examples of what is possible. Other uses and configurations are easily conceivable and are considered to be within the scope of the present invention.

The manner of using the preferred embodiment of the controller is that one places the shoulder strap 22 over the left shoulder. The MIDI cable 20 is plugged the MIDI IN of a MIDI interface or synthesizer. Data is generated when finger pressure is placed on the control surface 10, depressing a sensor 14. Due to the location of the controller on the operator's body, both hands may be utilized to manipulate the control surface.

The controller is re-configured by (a) replacing the graphic laminate covering the sensors, and by (b) installing a software program which changes the MIDI encoder so that it interprets the sensors in accordance with the new configuration. The graphic laminate in this present embodiment is a flexible sheet vinyl held by a thin frame. In this described embodiment he frame has holes in it to allow screws to hold it on the body. By removing the screws the frame and laminate may be lifted out of the controllers body. An alternate laminate and frame may then be installed, and the screws replaced. The MIDI controller's internal program may be changed and thus the function of the controller by reprogramming the ROM on the microcontroller 24 or by selecting a different pre-set program.

Advantages

From the description above, a number of musical control advantages are evident.

(a) Intervals greater than two octaves can be reached with one hand.
(b) Precise control of an attack can be made.
(c) Crescendos and decrescendos can be made on a held note.
(d) Very quick repetitious note initiations can be made.
(e) Interval distances and chord shapes are consistent throughout the control surface.
(f) Chords with many notes and interval types are possible.

In addition to the musical advantages, advantages exist when the controller is used with other types of machines.

(g) Performance artists can move and still operate media from any location in the performance space.
(h) It allows for greater facility as a portable computer keyboard for entering text into PDA, phone or other small devices than their built-in keyboards.
(i) It holds itself, meaning all fingers are available for input, unlike many common video game controllers.
(j) A sound or lighting engineer is free to move to get different perspectives on the effect of the program.

Accordingly, the reader will see that the machine controller of this invention provides a very powerful means of affecting computers and computer-like devices. It is effective for use with the complex machines of today and those of the future. It is flexible yet simple in design, and allows for a range of control and applications not currently available. A person in contact with it, with minimal knowledge in the art it is configured for, would understand its operation intuitively. It is ideally suited to play the role of a musical instrument. It has the ability to control multiple objects or aspects concurrently. Its three-dimensional command also makes it suitable for many multimedia applications, including performance art and video games.

While I have shown and described in this specification and its appended drawings figures only a embodiment in accordance with the present invention, it is understood that the invention is not limited to thereto, but is susceptible to numerous changes and modifications as would be known to one having ordinary skill in the art; and therefore do not wish to be limited to the details shown and described herein, but intend to cover all such modifications, changes, eliminations, and hybrids as are encompassed by the scope of the appended claims and their legal equivalents.

The invention claimed is:

1. A musical instrument controller, comprising:

(a) a body, with a means for attaching to a human operator, (b) a single array of eighty-four sensors affixed to the body in a position so that it is accessible to both hands of the operator when attached to the operator, said sensors having the capacity of detecting degrees of pressure, and configured so that active sensing areas form a grid, seven sensors wide by twelve sensors long, (c) a removable flexible cover for the sensors, with graphics printed on the cover, providing a control surface with visual references, that allows finger pressure to pass through to the sensors below, (d) a processing unit to detect the sensor pressure and translate the sensor pressure into digital control data, (e) a communication link for carrying the control data from the processing unit to a slave processor or synthesizer, (f) at least one raised or lowered area per sensor, on or under the cover, to provide a tactile reference for the operator, (g) said processing unit having the capability to hold in memory various sensor functions and arrangement programs, and a means for the operator to select between the programs.

2. The musical instrument controller of claim 1 wherein said means of attaching to human operator is a shoulder strap.

3. The musical instrument controller of claim 1 further including a means of producing sound within said body.

4. The musical instrument controller of claim 1 wherein said means for carrying said control data is a MIDI cable.

5. The musical instrument controller of claim 1 wherein said means for carrying said control data is a radio transmitter.

6. The musical instrument controller of claim 1 with additional control sensors, potentiometers and/or switches held by the body.

7. The musical instrument controller of claim 1 wherein the single array of force sensors is a multipoint touch screen.

* * * * *